US009035848B2

(12) United States Patent
Infante et al.

(10) Patent No.: US 9,035,848 B2
(45) Date of Patent: May 19, 2015

(54) MODULAR ACTIVE RADIATING DEVICE FOR ELECTRONICALLY SCANNED ARRAY ANTENNAS

(71) Applicant: Selex ES S.P.A., Rome (IT)

(72) Inventors: Leopoldo Infante, Rome (IT); Mario Teglia, Rome (IT); Armando Ciattaglia, Rome (IT)

(73) Assignee: SELEX ES S.P.A. (IT)

( * ) Notice: Subject to any disclaimer, the term of this patent is extended or adjusted under 35 U.S.C. 154(b) by 247 days.

(21) Appl. No.: 13/847,711

(22) Filed: Mar. 20, 2013

(65) Prior Publication Data

US 2013/0249772 A1 Sep. 26, 2013

(51) Int. Cl.
*H01Q 21/00* (2006.01)

(52) U.S. Cl.
CPC ..... *H01Q 21/00* (2013.01); *H01Q 21/0093* (2013.01)

(58) Field of Classification Search
USPC ..... 343/700 MS, 893
See application file for complete search history.

(56) References Cited

U.S. PATENT DOCUMENTS 6,067,053 A * 5/2000 Runyon et al. ..... 343/797
2013/0141299 A1* 6/2013 Mast et al. ..... 343/786

* cited by examiner

*Primary Examiner* — Tan Ho
(74) *Attorney, Agent, or Firm* — Volpe and Koenig, P.C.

(57) ABSTRACT

The invention concerns a device in the domain of AESA ("Active Electronically Scanned Array") systems required for e.g. radar multifunctional systems with communication capabilities and electronic/analysis countermeasures, providing a constructive element for the realization of modular active radiating panels, which are economic and scalable depending on the system needs, to be used on multi-roles and multi-domains platforms. The architecture according to the invention presents a so-called "tile" architecture and uses a multi-layer configuration incorporating the radiating elements, the control and supply controls, the transmitting/receiving (T/R) modules, the cooling system by using vertical interconnections, having a low cost and high integration.

13 Claims, 4 Drawing Sheets

MODULAR ACTIVE RADIATING DEVICE FOR ELECTRONICALLY SCANNED ARRAY ANTENNAS

FIELD OF INVENTION

The present invention concerns a modular active radiating device for electronically scanned array antennas.

BACKGROUND

The present invention places itself in the domain of AESA ("Active Electronically Scanned Array") system of new generation which are today required for e.g. Radar multifunctional systems with communication capabilities and electronic/analysis countermeasures, providing a constructive element for the realization of modular active radiating panels, which are economic and scalable depending on the system needs, to be used on multi-roles and multi-domains platforms. The architecture according to the invention presents a so-called "tile" architecture and uses a multilayer configuration incorporating the radiating elements, the control and supply controls, the transmitting/receiving (T/R) modules, the cooling system by using vertical interconnections, having a low cost and high integration. This architectural choice opposes to the so-called "brick" architecture with lower integration wherein the single elements are connected to each other by cables or adapters with high increase of costs, weights and reduction of performances.

The systems for AESA antennas in the known art are based at least partially on a patent made by Raytheon. Such approaches are highly technological and based on high investments and so-called "3D module" solutions, i.e. the circuits of the T/R module (receiving amplifier, transmitting amplifier, control logic board, power supply board, etc.) are disposed on more superimposed layers.

So-called "Integrated Tile Module" architectures are being developed by Anglo-Saxon subjects: someone utilizes approaches for the active 3D module wherein this is arranged on various layers instead of an only plane, others propose the use of packageless components (each transmitting/receiving module is without isolation box) realizable only with technologies that can be developed with high investment costs. It remains therefore the need of a solution that re-uses at best the existing devices combining them in accordance to a new and inventive technical concept, obtaining as an added value an optimization of weight, compactness and a reduction of costs both for the radiating part and the control and energy supply part.

US 2003/112184 A1 discloses a wide band GaAs microwave monolithic integrated circuit (MMIC) transmit chip that is capable of transmitting linearly or circularly polarized signals when connected to a pair of orthogonal cross-polarized antennas. In an active phased-array antenna environment, this transmit chip is capable of transmitting signals with different scan angles. This invention also contains a digital serial to parallel converter that uses TTL signal to control the phase shifter and attenuator circuits that are required for controlling the polarization and scan angle of the transmitted signal.

However, US 2003/112184 A1 presents a topological structure of the modular active element that is not compact and therefore is particularly expensive and not enough effective.

SUMMARY

It is object of the present invention to provide a tile which solves the problems and overcomes the drawbacks of the prior art.

It is further specific object of the present invention to provide a complete radiating planar antenna realized by the juxtaposition of more tiles (which can be placed side-by-side on the four sides without altering the geometry of the lattice of the overall radiating aperture) which solves the problems and overcomes the drawbacks of the prior art architectures.

It is subject-matter of the present invention a modular active radiating device for electronically scanned array antennas, comprising the following sets of components:

- a first set including active radiating elements comprised of T/R modules, radio-frequency switching devices and radiating elements;
- a second set including a thermal stabilization system;
- a third set including a supply and control system;

said first, second and third sets are disposed on different separable planes united by reversible fixing means to form a multi-layer structure, the device further comprising vertical interconnections connecting elements of said third set to elements of said first set going across said second set;

the device being characterized in that:

- said first set comprises:
  - one multi-layer printed circuit board including:
    - radiating elements layers;
    - first power distribution means layers;
    - first control signal means layers;
    - beamforming network layers;
  - the different layers being suitably interconnected by via-holes;
  - the T/R modules welded on the one multi-layers printed circuit board,
  - the radio-frequency switching devices welded on the multi-layer printed circuit board;
  - first support electronic components welded on the one multi-layers printed circuit board;
- said multi-layer printed circuit board is formed by a plurality of contiguous modules termed flowers, each flower being formed by two or more quadrangular elementary portions placed side-by-side and termed petals, each petal constituting a single phase center and comprising:
  - an only active radiating element, comprised of one or two T/R modules, a radio-frequency switching device and radiating elements, and
  - contacts for said vertical interconnections, arranged close to one or more sides of said petals, along only a portion of each of said one or more sides, in such a way that the contacts are at least partially facing to each other between side-by-side petals, so that said vertical interconnections can cross said second set and connect said first set to said third set without jeopardizing the continuity of the thermal stabilization system, which is in particular a back plane cold plate.

In US 2003/112184 A1, the unit cell is not an elementary radiating element, because four of them are needed to have a phase center with double polarization. In the invention case, the phase center is the single petal center. This is important because each center is guided by a dedicated electronics.

In other words, an active radiating element is based on a single patch. In the case of US 2003/112184 A1 the single patch is not associated to an only phase center, therefore the contacts cannot pass between two invention petals, but only between groups of four patches.

According to an aspect of the invention, said vertical interconnections are solderless push connectors for carrying low-frequency signals, to allow an easy assembling and disassembling of said first, second and third sets.

According to an aspect of the invention, said third set comprises a further printed circuit board with second power distribution means layers and second control signal means layers, connected by the vertical interconnections to the corresponding first power distribution means layers and first control signal means layers, so that the vertical connections are minimized in number.

According to an aspect of the invention, said contacts are arranged in the proximity of only a side of said petals.

According to an aspect of the invention, said contacts extend in the proximity of said an only side starting from a vertex of the side along a portion thereof, so that a vertical interconnection relevant to said contacts can connect two side-by-side petals.

According to an aspect of the invention, said contacts are arranged in the proximity of two sides forming an angle.

According to an aspect of the invention, said contacts extend in the proximity of said two sides forming an angle, in particular starting from the common vertex of the two sides along a portion of each side, so that a vertical interconnection relevant to said contacts can interconnect side-by-side petals, possibly belonging to two different modules.

According to an aspect of the invention, the T/R modules (141) are within a BGA face-down housing.

According to an aspect of the invention, each of the active radiating elements comprises a feedline in balanced microstrip, a patch and a slot circuit which guarantees the coupling between said feedline and said patch. According to an aspect of the invention, said radio-frequency switching elements are circulators.

According to an aspect of the invention, an only T/R module is welded to said an only active radiating element. It is further subject-matter of the present invention an electronically scanned array antenna, comprising a plurality of modular active radiating devices, characterized in that the modular active radiating devices are constituted by two or more devices constructed in accordance with the invention.

BRIEF DESCRIPTION OF THE DRAWINGS

The invention will be now described by way of illustration but not by way of limitation, with particular reference to the figures of the annexed drawings.

DETAILED DESCRIPTION OF THE PREFERRED EMBODIMENT(S)

Figure 1:
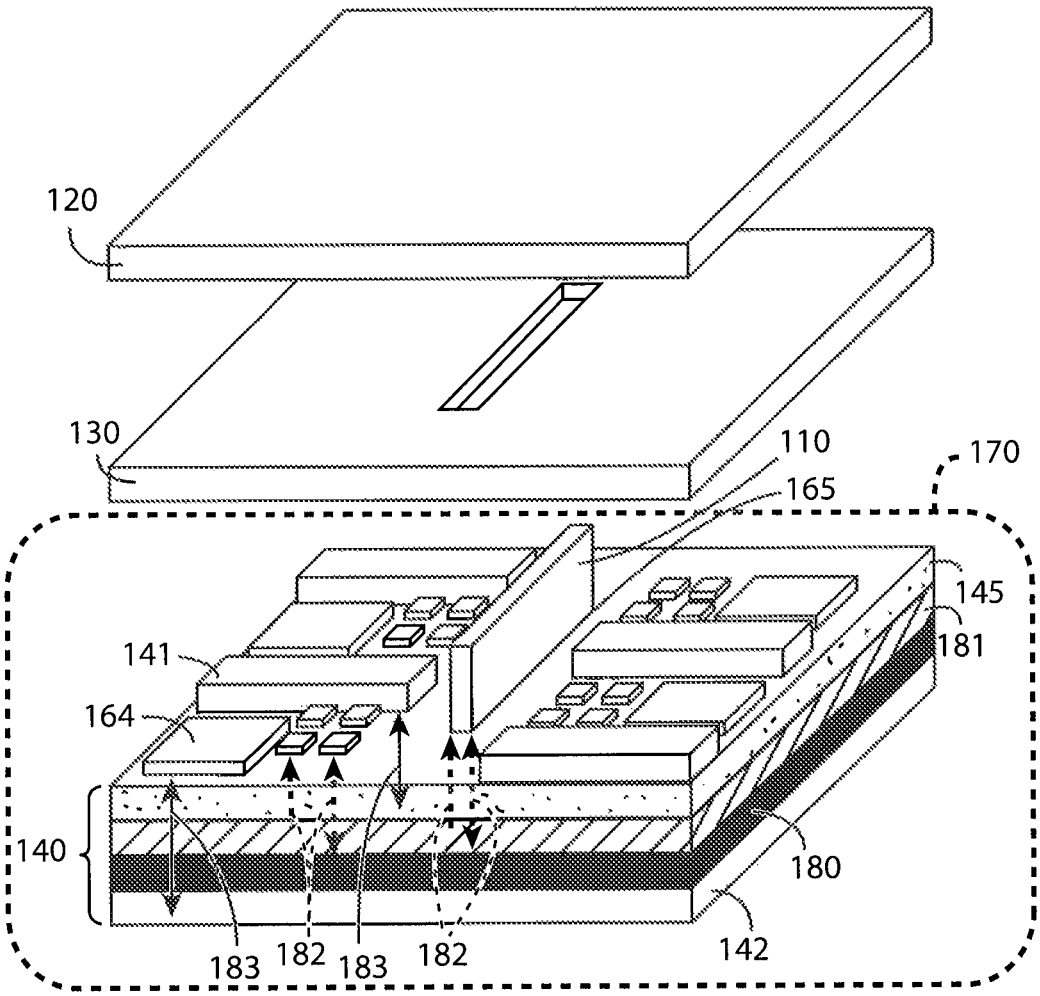
FIG. 1 depicts a 3D sketch of the active radiating tile integrating the radiating board 140, the cooling board 130 and the power and control signal board 120.

FIG. 1 depicts the stack-up of the invention tile by emphasizing the position of the radiating and beamforming layers, power layers and control signal layers constituting the motherboard 140. RF orthogonal via-holes 183, represented by black arrows, provide the connection among the different layers, giving the main priority to the RF path considered among the antenna elements layer 142 and the switching 164 and the transmitting/receiving module (TRM) 141 and the beamforming network layer 145. It is important to note that the beamforming network layer 145 is embedded to the motherboard 140 constituted by layers 142,180,181 and 145.

Usually the active devices such as the TRM (141) need:

- power supply to provide the bias voltage for all active components such as high-power amplifier (TX mode), low-noise amplifier (RX mode) and core-processor such as variable phase shifters and variable attenuators used for beam steering and amplitude taper;
- control signals used for the setting of the states of the variable components included in the core-processor essentially setting the bit states for the variable phase shifters and variable attenuators.

In the present embodiment the power signals and the control signal are located on the motherboard at the bottom layers identified by 180 and 181, respectively as showed in FIG. 1.

A further set of orthogonal vias-holes 182, similar to RF vias, and depicted by dashed arrows in FIG. 1, provides the connection among all the active devices, such as TRM, support electronic components, welded on the top of the motherboard 140 and the power supply board 180 and control signal board 181, respectively.

The description given before solve the connection problem at the sub-grid 161 (FIG. 1 and FIG. 3) grouping 2×2 radiating elements constituting four petals.

At this stage, by using a proper disposition of the radiating elements (rotating 180° one column with respect to the other) a clearance is obtained at the center of the 2×2 sub-grid 161.

The 180° rotation of the even columns is recovered by the phase-shifter and it is usually realize in common phased array architecture.

The center clearance in 161 is used for an interposer connectors that provide connection among the layers 180 and 181 and the power and control logic board 120.

Since the tile is working without metallic backplane properly soldered on the radiating board, the rigidity of the overall structure is provided by the retaining mechanism provided by supporting screws mounted on one side at 140, crossing 130 and holding the layer 120.

The board 120 includes all the resultant support electronic equipment needs for power and logic signals that could not welded on 140 for the lack of space.

Moreover 120 includes FPGA, line driver, bulky booster capacitors for bias voltage regulations that

- require space and can be expanded along the depth dimension opposite to the radiating side
- require a thermal stabilization that can be provided by the cooling plate 130 mounted on the bottom.

This solution explicit the dual-use of the cooling plate 130 providing thermal stabilization for the active devices welded on 140 and 120.

The RF path is following a different path from the power and control signals previously described.

By following the black arrow in FIG. 1, the RF signals coming from/to the TRM 141 remain embedded in the layers 145. In 145 a suitable set of corporate beamforming network realized by Wilkinson power dividers ending at one single input connector identified by 167 in FIG. 3 soldered on the motherboard 140. To avoid conflicts with the cooling plate a clearance is left on 130 to allow the access to the only single RF connector.

The cooling metallic plate thus provides the support for the whole tile and it may be fixed to a back structure that collects several tiles juxtaposed to form a large planar aperture. This latter solution provides an easy mechanism to disassemble the tile for maintenance and logistic operations and it may constitute an advantage when the antenna is mounted on an a mast and it is not accessible from the outside cover but only from the back side.

Making reference to figure, one describes an embodiment of the tile device 100 according to the invention.

A plurality of separable layers 120,130,140 are present and united together by fixing means 151,152:

a first layer 120 is a layer of supply and control;

a second layer 130 is a cooling layer ("cold plate");

a third layer 140 is a RF transmission and reception layer including a radiating element.

The various layers are electrically connected by vertical interconnections 110 which cross the second layer and connect to the first and third layer in correspondence of suitable connectors 111, 112.

Figure 2:
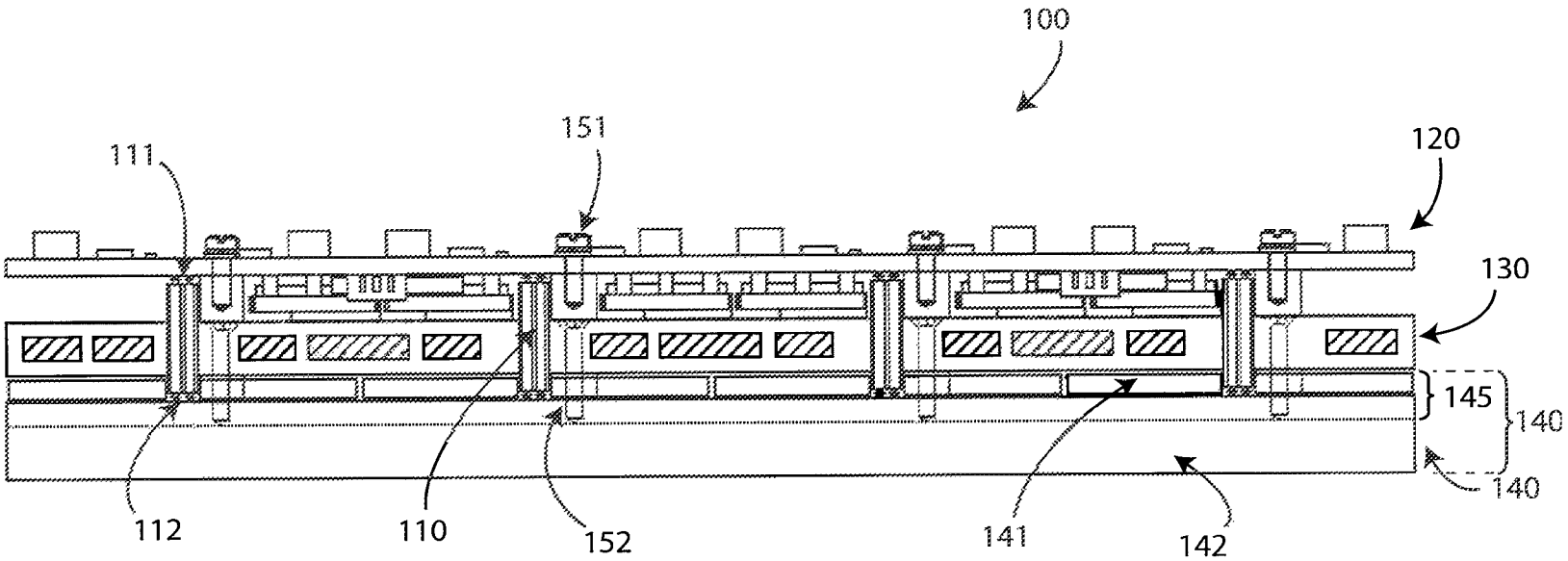
FIG. 2 shows a sectional view of the tile device according to the invention.

The approach of the invention utilizes T/R modules with BGA ("Ball Grid Array") package 141 disposed on a single level. One exploits a particular disposition of the BGA 141 with respect to the radiating element 142 (not shown in detail in FIG. 2). This particular disposition of the modules T/R and relevant radiating elements with utilization of an active overall level 145, internal to the layer 140, allow to obtain space in the above-mentioned level, which is then utilized to insert contacts for connectors relevant to the supply and control signals needed for the functioning of the active modules included in the RF-board 140 and for the connection of the latter to the upper circuit relevant to the layer 120. In such a way, orthogonal transitions are used to allow low losses and high integration interconnections between power sources and control logic and the T/R modules.

Figure 3:
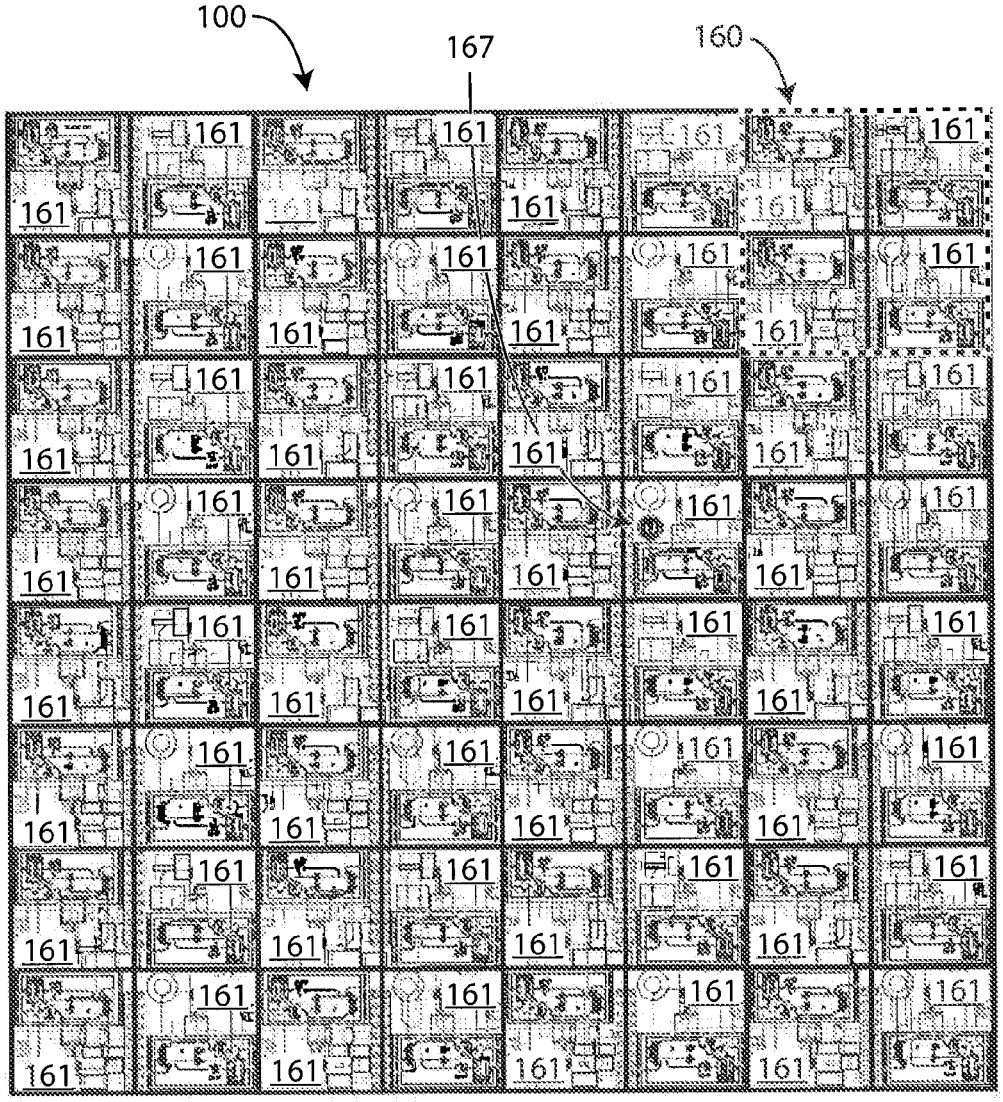
FIG. 3 shows the layout of an embodiment of the tile device according to the invention in the format 8×8.
Figure 4:
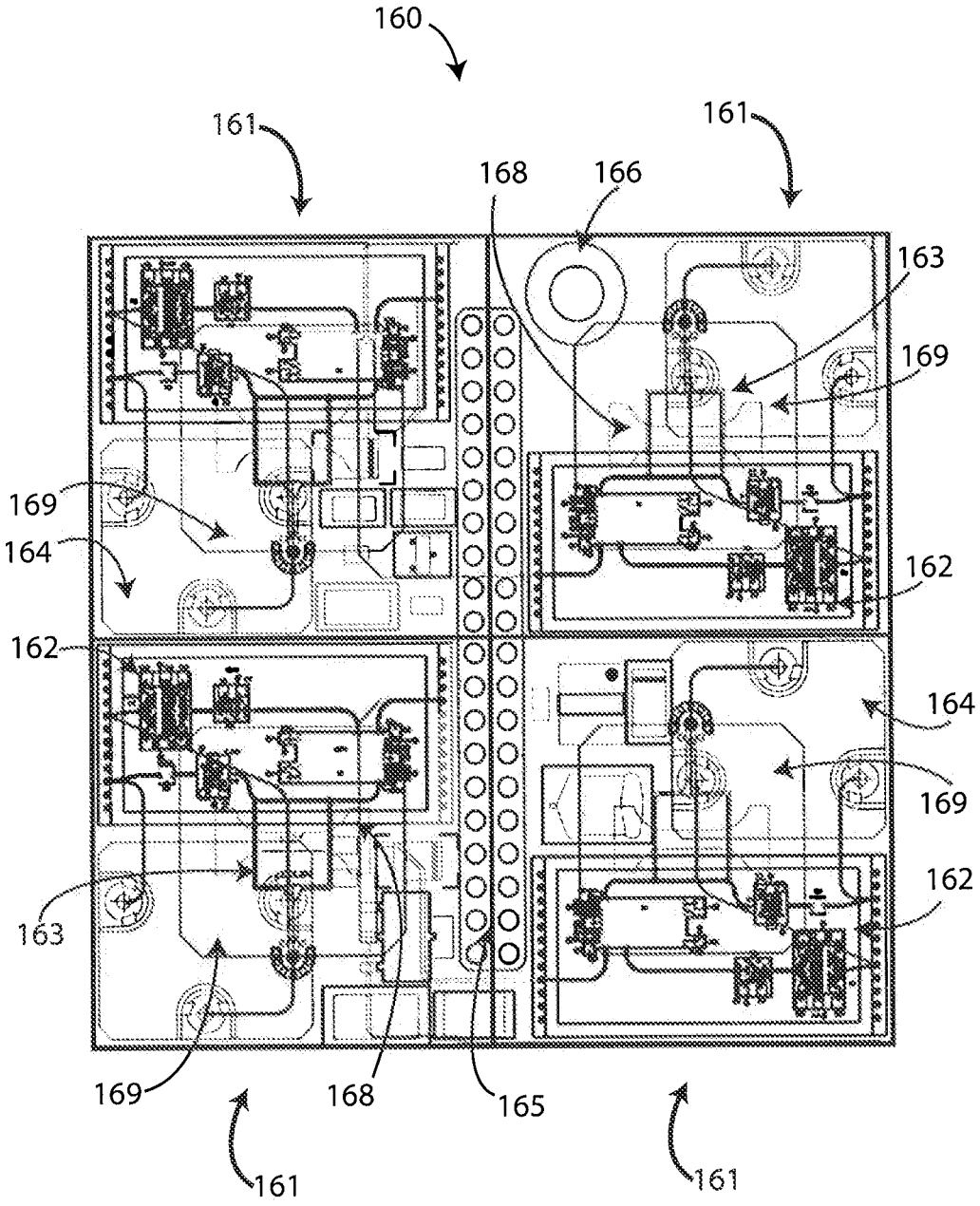
FIG. 4 shows a portion of the tile of FIG. 2 in greater detail, where objects laying on different layers can be seen in transparency.

According to the embodiment illustrated in FIGS. 3 and 4, the active tile here proposed is constituted by laminate multilayer circuits (FIG. 2) where T/R modules and relevant circuitry is placed on.

The first layer "RF Board" houses a matrix of 8×8 modules. Each module 160 is constituted by 4 elements or "petals" 161 including as many T/R modules for radar in C band (or other bands in other embodiments), housed in packages of the BGA "Face down" type 162, integrated in an only printed circuit with the radiating elements 163 of the type "Aperture Coupled Stacked Patch" and a first stage of beam forming (not shown), developed inside the layer 145, which collects the 64 RF outputs of the T/R modules and provides an only RF connector 167 in FIG. 3.

The third layer of supply and control houses the supply and control circuits (not shown) with the optical transceiver for the fiber connection to the remaining part of the system, having high immunity to electromagnetic disturbances, wide band and low weight/dimensions.

The dimensions of the tile according to the invention will be a function of the working frequency and the number of radiating elements and T/R modules that will be possible to integrate considering the limits of dissipation of the cooling circuit. The number of radiating elements of the overall phased array aperture will be given by the total number of juxtaposed tiles. The tile is considered a sub-array, identified by an only RF connector 167 (FIG. 3) which can be integrated with a layer integrating the receiving chain otherwise external (conveniently realized in multi-layer technology).

The radiating element is constituted by a patch 169 suitably shaped and inserted into a lattice such that it guarantees a good impedance adaptation of the antenna in the operation band for wide scanning angles of the beam. The capacitive coupling between the patch 169 and the feedline in balanced microstrip 163 is made by a slot 168 (which finds itself between the feed-line 163 and the external patch 169) with a form of hourglass 168 suitably shaped to satisfy the requisites of adaptation in wide frequency band.

Thanks to an advanced technological solution of vertical interconnection, the two printed circuits placed on the two faces of the liquid cooler plate (or "cold plate" 130 in FIGS. 1 and 2) are connected to each other, for the functions of supply and control signals, by means of elastic solderless connectors which cross them. Thanks to the structure in accordance with the invention, the two above-mentioned circuits present immediate accessibility for possible maintenance.

The architectural solution of the tile provides for the juxtaposition of a plurality of intermediate modules or "flowers" each formed by four elementary modules or "petals" (cf. FIGS. 3 and 4). The petals which are opposed on the diagonal of the four-petals flower are equal but rotated of 180° with respect to the axis perpendicular to the plane of the petal (i.e. the axis of polarization of the antenna, in this case vertical), the equality is here established with respect to the dimensions due to the most bulky components, i.e. the disposition of the BGA, the circulator 164, the contacts 165 for the connector 110 and the radiating element). On one of the four petals, a hole 166 for fixing the upper plate is made.

This disposition creates a central free zone on cells of 2×2 periodicity, which allows the passage of the above-mentioned supply and digital interconnections as well as an easy disposition of the circulator and the T/R module. The rotation of 180° of the radiating element is recovered by the phase shifter which is present in the T/R module and presents remarkable advantages in terms of reduction of the cross-polar component of the antenna.

In an embodiment, 4×4 flowers are arranged to form a tile of 64 petals (cf. FIG. 3). Naturally, one can juxtapose the flowers also with other planar pattern which are not e.g. rectangular, but are irregular of the L-shaped tile or polyomini type (to the end of integrating the radiating surfaces into non-planar supporting structures, such as naval towers and the like also called conforming surfaces).

The configuration with the rotated petals as above is only one of the possible embodiments. Indeed, the petals can be printed directly with the necessary space for the contacts directly in the desired areas and the other elements in the remaining space, directly printing four different petals.

The tile according to the invention represents a solution totally original and innovative utilizing however single prior art components, since it allows to have in an only scalable panel all the main functions of an active antenna: radiating elements, T/R modules, beam combination network, cooling, supply and control. Such panels, in particular of 64 elements, disposed in a 8×8 matrix, are designed to be easily combined to form planar and non-planar antennas, allowing a high scalability at the system level.

The cost reduction estimate is higher than 50% for the reduction of the interconnections and connectors, reduction of costs of integration due to utilization of multilayer technology, low-cost realization techniques for networks and radiating elements.

The used package allows to minimize the microwaves path through the T/R module towards the antenna, so as to reduce its RF losses: in particular the BGA face-down solution permits the use of layers for the control circuit with SMT ("Surface Mounted Technology") placed on the top of the MMIC ("Macrowave Multichip Integrated Device") components thanks to the dense vertical connection, and allows at the same time to obtain an efficient thermal exchange of the power generation part with the cooling plate.

The layers structure of the device according to the invention, held together by simple fixing means such as screws, makes it easier the production and maintenance. The solution offers clear advantages for compactness and lightness of the assembly: the structure is frequency scalable (because one can easily vary the dimensions) and this allows to cover the other segments of RF band. The active tile allows the realization of a new family if radar sensors which are ultra-compact, low energy consuming and scalable with respect to platforms, domains and scenarios.

The competitive advantage comes from having at disposal an integrated solution of arrays of high-technology active modules with which radiating systems can be realized having variable dimensions and configuration for various typologies of radar systems and communications both military and civil presenting a time-to-market extremely reduced due to reuse and reduction of development times. The modularity of the solution allows a considerable application flexibility: with the same building-block, the adaptation of the tile is possible as depending on the needs and requirements, for the realization of different radiating systems comprised of the cooling, control and supply parts.

The scalability supported by the device according to the invention is a key value point for the utilization in operative scenarios needing AESA ("Active Electronically Scanning Array") systems both in naval, terrestrial and avionic environment. The solution according to the invention, thanks to its compactness and lower losses with respect to the traditional approach, presents lower energetic consumptions with reduction of environmental impacts.

The solution according to the invention operates on a wide frequency band and therefore offers the possibility of being used in multi-band and multifunctional radar systems. The solution lends itself well also to the use for systems that are compact and easily deployable so that they can be organized into a network, as for example in the domestic security applications for the radars that "see" through the walls, or in applications wherein it is necessary to guarantee greater robustness to interferences or having the ability of diversify the transmission band in case of adverse weather conditions. Other fields of use can be referred to radio bridges, Imaging Radar systems and finally in those applications wherein the antenna itself, although respecting the compactness and inexpensiveness requirements, must serve for multiple functions. An application example can be for the radiating part of a multifunction radar.

The solution adopted here provide an high level of integration device (the active radiating tile) that can be used as building block to create a large planar aperture antenna for radar systems.

In order to reduce the project risks and the production costs, the radio-frequency (RF) path that groups all elementary antennas composing the tile has been realized and optimized by a manufacturing process based on dedicated layers connected each other by means of via-holes.

In this way the number of RF connectors is further reduced and the radiating board can be manufactured by mixing high performance laminates (Teflon-based) dedicated to the RF parts (such as antenna elements and beamforming network) and commercial laminates (as the one used for cpu motherboard) used for the low frequency parts such as power and control logic board.

In the foregoing, embodiments have been described and variations of the present invention has been suggested, but it is to be understood that those skilled in the art will be able to modify them without falling outside the scope of the invention, as defined in the enclosed claims.

Embodiment include, but are not limited to, the following example numbered embodiments:

1) Modular active radiating device (100) for electronically scanned array antennas, comprising the following sets of components:

- a first set (170) including active radiating elements (163, 164,141,142) comprised of T/R modules (141), radio-frequency switching devices (164) and radiating elements (142);
- a second set (130) including a thermal stabilization system;
- a third set (120) including a supply and control system;

said first (170), second (130) and third (120) sets are disposed on different separable planes united by reversible fixing means (151) to form a multi-layer structure, the device further comprising vertical interconnections (110) connecting elements of said third set (120) to elements of said first set (170) going across said second set (130); the device being characterized in that:

said first set (170) comprises:

- one multi-layer printed circuit board (140) including:
  - radiating elements (142) layers;
  - first power distribution means layers (181);
  - first control signal means layers (180);
  - beamforming network layers (145);
- the different layers being suitably interconnected by via-holes (182);
- the T/R modules (141) welded on the one multi-layers printed circuit board,
- the radio-frequency switching devices (164) welded on the multi-layer printed circuit board;
- first support electronic components welded on the one multi-layers printed circuit board;

said multi-layer printed circuit board is formed by a plurality of contiguous modules (160) termed flowers, each flower being formed by two or more quadrangular elementary portions (161) placed side-by-side and termed petals, each petal constituting a single phase center and comprising:

- an only active radiating element (163,164,141,142), comprised of one or two T/R modules (141), a radio-frequency switching device (164) and radiating elements (142), and
- contacts (165) for said vertical interconnections (110), arranged close to one or more sides of said petals, along only a portion of each of said one or more sides, in such a way that the contacts are at least partially facing to each other between side-by-side petals, so that said vertical interconnections (110) can cross said second set (130) and connect said first set (170) to said third set (120) without jeopardizing the continuity of the thermal stabilization system, which is in particular a back plane cold plate.

2) Device according to embodiment number 1, characterized in that said vertical interconnections (110) are solderless push connectors for carrying low-frequency signals, to allow an easy assembling and disassembling of said first, second and third sets.

3) Device according to embodiment number 1 or 2, characterized in that said third set comprises a further printed circuit board with second power distribution means layers and second control signal means layers, connected by the vertical interconnections to the corresponding first power distribution means layers and first control signal means layers, so that the vertical connections are minimized in number.

4) Device according to any embodiment number 1-3, characterized in that said contacts (165) are arranged in the proximity of only a side of said petals (161).

5) Device according to embodiment number 4, characterized in that said contacts (165) extend in the proximity of said an only side starting from a vertex of the side along a portion thereof, so that a vertical interconnection (110) relevant to said contacts (165) can connect two side-by-side petals.

6) Device according to any embodiment number 1-3, characterized in that said contacts (165) are arranged in the proximity of two sides forming an angle.

7) Device according to embodiment number 6, characterized in that said contacts (165) extend in the proximity of said two sides forming an angle, in particular starting from the common vertex of the two sides along a portion of each side, so that a vertical interconnection (110) relevant to said contacts can interconnect side-by-side petals, possibly belonging to two different modules (160).

8) Device according to any embodiment number 1-7, characterized in that the T/R modules (141) are within a BGA face-down housing (162).

9) Device according to any embodiment number 1-8, characterized in that each of the active radiating elements comprises a feed-line in balanced micro-strip (163), a patch (169) and a slot circuit (168) which guarantees the coupling between said feed-line (163) and said patch (169).

10) Device according to any embodiment number 1-9, characterized in that said radio-frequency switching elements (164) are circulators.

11) Device according to any embodiment number 1-10, characterized in that an only T/R module is welded to said an only active radiating element (163,164,141).

12) Electronically scanned array antenna, comprising a plurality of modular active radiating devices (100), characterized in that the modular active radiating devices (100) are constituted by two or more devices (160) constructed in accordance with any embodiment number 1-11.

What is claimed is:

1. A modular active radiating device for electronically scanned array antennas comprising:

a first set of components including active radiating elements comprised of transmit/receive modules, radio-frequency switching devices and radiating elements;

a second set of components including a thermal stabilization system;

a third set of components including a supply and control system;

said first, second and third sets of components disposed on different separable planes united to form a multi-layer structure, vertical interconnections connecting elements of said third set to elements of said first set going across said second set;

said first set including:

a multi-layer printed circuit board having:

a radiating elements layer;

a first power distribution layer;

a first control signal layer;

a beamforming network layer;

the different layers being suitably interconnected by via-holes;

the transmit/receive modules affixed to the multi-layer printed circuit board, the radio-frequency switching devices affixed to the multi-layer printed circuit board;

first support electronic components affixed to the multi-layer printed circuit board;

the multi-layer printed circuit board being formed by a plurality of contiguous flower modules;

each flower module being formed by two or more quadrangular elementary petal portions placed side-by-side;

each petal portion constituting a single phase center and comprising:

an only active radiating element comprised of:

one or two transmit/receive modules, a radio-frequency switching device, and radiating elements, and contacts for said vertical interconnections, arranged close to one or more sides of said petal portions, along only a portion of each of said one or more sides, in such a way that the contacts are at least partially facing to each other between side-by-side petal portions, so that said vertical interconnections can cross said second set and connect said first set to said third set without jeopardizing the continuity of the thermal stabilization system.

2. The device according to claim 1 wherein the thermal stabilization system is a back plane cold plate.

3. The device according to claim 1, wherein said vertical interconnections are solderless push connectors for carrying low-frequency signals, to allow an easy assembling and disassembling of said first, second and third sets.

4. The device according to claim 1, wherein said third set comprises a second printed circuit board with a second power distribution layer and a second control signal layer connected by the vertical interconnections to the corresponding first power distribution layer and first control signal layer.

5. The device according to claim 1, wherein said contacts are arranged in the proximity of only one side of said petal portions.

6. The device according to claim 5, wherein said contacts extend in the proximity of said only one side starting from a vertex of the side along a portion thereof, so that a vertical interconnection relevant to said contacts can connect two side-by-side petals.

7. The device according to claim 1, wherein said contacts are arranged in the proximity of two sides forming an angle.

8. The device according to claim 7, wherein said contacts extend in the proximity of said two sides forming an angle, in particular starting from a common vertex of the two sides along a portion of each side, so that a vertical interconnection relevant to said contacts can interconnect side-by-side petal portions, possibly belonging to two different flower modules.

9. The device according to claim 1, wherein the transmit/receive modules are within a Ball Grid Array face-down housing.

10. The device according to claim 1, wherein each of the active radiating elements comprises a feed-line in balanced micro-strip, a patch and a slot circuit which guarantees the coupling between said feed-line and said patch.

11. The device according to claim 1, wherein said radio-frequency switching elements are circulators.

12. The device according to claim 1, wherein an only transmit/receive module is welded to said an only active radiating element.

13. An electronically scanned array antenna, comprising a plurality of modular active radiating devices in accordance with claim 1.

* * * * *